US008978426B2

(12) United States Patent
Wang

(10) Patent No.: US 8,978,426 B2
(45) Date of Patent: Mar. 17, 2015

(54) HIDDEN SHACKLE LOCK INCORPORATING A "KEY-IN-KNOB" (KIK) CYLINDER

(75) Inventor: Wei Kai Wang, Zhejiang (CN)

(73) Assignee: Pacific Lock Company, Valencia, CA (US)

( * ) Notice: Subject to any disclaimer, the term of this patent is extended or adjusted under 35 U.S.C. 154(b) by 1956 days.

(21) Appl. No.: 11/907,149

(22) Filed: Oct. 10, 2007

(65) Prior Publication Data

US 2008/0105004 A1 May 8, 2008

Related U.S. Application Data

(60) Provisional application No. 60/857,189, filed on Nov. 7, 2006.

(51) Int. Cl.
*E05B 67/36* (2006.01)

(52) U.S. Cl.
CPC ..... *E05B 67/36* (2013.01)
USPC ..... 70/34; 70/14; 70/371

(58) Field of Classification Search
USPC ..... 70/6, 14, 32–34, 50–52, 370, 371, 70/379 R, 416
See application file for complete search history.

(56) References Cited

U.S. PATENT DOCUMENTS 1,564,463 A * 12/1925 Best ..... 70/380
2,460,615 A * 2/1949 Andrew ..... 70/369
3,143,872 A * 8/1964 Check ..... 70/38 A
3,172,279 A * 3/1965 Patriquin ..... 70/38 A
3,404,549 A 10/1968 Best
3,817,062 A 6/1974 Randel
3,820,360 A 6/1974 Best
3,882,699 A * 5/1975 Flack et al. ..... 70/38 A
4,068,510 A * 1/1978 Neary ..... 70/379 R
4,075,878 A * 2/1978 Best ..... 70/49
4,109,496 A * 8/1978 Allemann et al. ..... 70/380
4,228,669 A * 10/1980 Bischoff ..... 70/379 R
4,254,648 A * 3/1981 Dietrich ..... 70/380
4,328,690 A * 5/1982 Oliver ..... 70/369
4,672,828 A 6/1987 Theriault (Continued)

OTHER PUBLICATIONS

Letter from Mr. John Ulaszek to Mr. Gregory Waugh, President of Pacific Lock Company, the Assignee of the current application, 3 pages, Jan. 22, 2007.

(Continued)

*Primary Examiner* — Carlos Lugo
*Assistant Examiner* — Alyson M Merlino
(74) *Attorney, Agent, or Firm* — Patent Law Agency, LLC; Peter Ganjian

(57) ABSTRACT

A hidden shackle style lock is disclosed. The lock has a substantially cylindrical housing having a top surface, a bottom surface, and a curved side surface. The lock also has a first cavity on the bottom surface of the housing which extends part way along a thickness of the housing, and a second cavity on the side surface intersecting with the first cavity. The lock further includes has a hollow sleeve slidably attached within the second cavity. The sleeve has a first end face, a second end face, and a third cavity. The third cavity extends from the first end face to the second face and is substantially coaxial with the second cavity. A shackle is coupled to the first end face of the sleeve. A core member with a locking mechanism is disposed within the third cavity and coupled to the shackle. A driver member is located between the core member and the shackle and couples the core member to the shackle.

20 Claims, 5 Drawing Sheets

(56) References Cited

U.S. PATENT DOCUMENTS

| | | | | |
|---|---|---|---|---|
| 4,793,166 | A | 12/1988 | Marks | |
| 4,926,670 | A * | 5/1990 | Deforrest, Sr. | 70/374 |
| 5,121,618 | A * | 6/1992 | Scott | 70/367 |
| 5,127,244 | A | 7/1992 | Myers | |
| 5,174,136 | A * | 12/1992 | Thwing | 70/38 A |
| 5,193,372 | A * | 3/1993 | Sieg et al. | 70/369 |
| D336,030 | S | 6/1993 | Falk et al. | |
| 5,233,851 | A | 8/1993 | Florian | |
| 5,345,794 | A | 9/1994 | Jenks | |
| 6,109,080 | A | 8/2000 | Chen et al. | |
| 6,146,356 | A * | 11/2000 | Wang et al. | 604/96.01 |
| 6,338,261 | B1 | 1/2002 | Liu | |
| 6,425,274 | B1 * | 7/2002 | Laitala et al. | 70/394 |
| 6,606,890 | B1 | 8/2003 | Widen | |
| 6,634,196 | B2 | 10/2003 | Huang | |
| 6,758,075 | B1 * | 7/2004 | Thwing | 70/389 |
| 6,766,671 | B2 * | 7/2004 | Haczynski et al. | 70/23 |
| 6,883,356 | B1 * | 4/2005 | Wu | 70/379 R |
| 6,948,345 | B1 * | 9/2005 | Ruan | 70/370 |
| RE38,832 | E | 10/2005 | Thwing | |
| 7,003,994 | B2 * | 2/2006 | Ruan | 70/416 |
| 7,047,774 | B1 * | 5/2006 | Gogel | 70/32 |
| 2005/0199027 | A1 | 9/2005 | Mannella | |
| 2005/0252257 | A1 | 11/2005 | Woods et al. | |
| 2008/0105005 | A1 * | 5/2008 | Wang | 70/32 |

OTHER PUBLICATIONS

Letter from Mr. John Ulaszek to Mr. Gregory Waugh, President of Pacific Lock Company, the Assignee of the current application, 3 pages, Feb. 9, 2007.

Provisional application cover sheet for U.S. Appl. No. 60/220,416, filed Jul. 24, 2000 and an attached page with a figure.

Security Padlock Uses IC Core Cylinders, Gale Johnson, Locksmith Ledger, vol. 60, No. 13 (4 pages).

Pacific Lock, Gregory B. Waugh, The National Locksmith, Jan. 2006, 6 pages.

Pacific Lock Introduces the World's First Hockey-Pucks for SFIC's and KiK Cylinders, The National Locksmith, Jan. 2007, 6 pages.

Lynk, William M., "Interchangeable Cores Small Format," The National Locksmith, 2000, 44 pages.

Johnson, Gale, Xperinetix Has a Better Idea, The Locksmith Ledger, Dec. 2000, 5 pages, San Diego, CA.

* cited by examiner

HIDDEN SHACKLE LOCK INCORPORATING A "KEY-IN-KNOB" (KIK) CYLINDER

CROSS REFERENCE TO RELATED APPLICATIONS

This application is based upon and claims the benefit of priority from U.S. Provisional Application No. 60/857,189 to Wei Wang filed on Nov. 7, 2006, the entire contents of which are incorporated herein by reference.

TECHNICAL FIELD

The present disclosure relates to a hidden shackle style lock, and more particularly to a hidden shackle style lock incorporating a "Key-in-Knob" (KiK) cylinder.

BACKGROUND

In a common locking device, such as an exposed shackle type padlock, a U-shaped hinged shackle is passed through one or more rings (or through-holes), and the free end of the shackle inserted and retained in a bore on the housing of the padlock. The rings are now said to be locked using the padlock. In such an exposed shackle type locking device, the shackle is exposed, and therefore prone to attack (applying torque to the shackle, applying a tension force to the shackle, cutting the shackle, etc.). A hidden shackle style locking device (hereinafter referred to as a 'hockey puck lock') is sometimes used to prevent access to the shackle and thereby reduce such attack. A hockey puck lock has a generally stubby cylindrical shape with a rounded front and back surface. The rounded back surface defines a generally rectangular cavity to receive one or more parallel plates (which are to be locked together) with mating through-holes. A cylindrical shackle coupled to a central cylinder having a locking mechanism therein is slidably disposed on the housing to lock the one or more parallel plates together. To lock the parallel plates together using such a hockey puck lock, the parallel plates with the mating through-holes are located within the rectangular cavity, and the shackle is slid through these through-holes. An operator key is then used to activate locking pins in the central cylinder allowing the shackle to rotate and, thereby, engage with locking feature provided in the housing. When the shackle turns, a groove or a tab formed on the tip of the shackle engages with a corresponding geometry within the cylindrical cavity, thereby locking the shackle in place.

A KiK cylinder is a type of central cylinder with a locking mechanism that is commonly available in the market. For instance, common residential front door locks incorporate KiK cylinders in their design. Due to the wide popularity of KiK cylinders, and their wide spread use in a variety of locking applications, the outer dimensions of the KiK cylinders have been standardized. The working part of the cylinder (the part which interacts with the lock housing) uses an intermediary called a tail piece or a driver to adapt to a particular brand of lock. Generally, there are three versions of tail pieces used to accommodate the various types of KiK cylinders. These versions of tail pieces are named, "the schlage® driver," "the lori driver," and "medeco® driver," after major lock suppliers whose locks these drivers are designed to interface with. It should be noted, however, that each of these drivers can be used with KiK cylinders from a number of lock manufacturers. For instance, the schlage® driver can be used with KiK cylinders from lock manufacturers other than Schlage®. Due to the wide availability of KiK cylinders, it would be advantageous to incorporate the KiK cylinder in a hockey puck lock.

In a common lock incorporating a KiK cylinder, the KiK cylinder is slid into the housing (in a longitudinal direction) of the lock, locked in place, and then used to operate the lock. Operating the lock allows a shackle to move in a plane perpendicular to the longitudinal axis of the KiK cylinder to lockingly engage with a locking feature. In a hockey puck lock, however, the locking operation requires the shackle (along with the attached central cylinder) to slide along its longitudinal axis before it lockingly engages with the locking features in the lock housing. That is, if sliding along the longitudinal axis is utilized to insert the KiK cylinder in a hockey puck lock, unlocking the lock may also cause the KiK cylinder to be separated from the housing. Therefore, incorporating a KiK cylinder into a hockey puck lock, without causing the KiK cylinder to detach from the lock housing every time the lock is unlocked, is challenging.

The present disclosure relies on novel design features to incorporate a KiK cylinder in a hockey puck lock.

SUMMARY OF THE INVENTION

In one aspect, a hidden shackle style lock is disclosed. The lock has a substantially cylindrical housing having a top surface, a bottom surface, and a curved side surface. The lock also has a first cavity on the bottom surface of the housing which extends part way along a thickness of the housing, and a second cavity on the side surface intersecting with the first cavity. The lock further includes has a hollow sleeve slidably attached within the second cavity. The sleeve has a first end face, a second end face, and a third cavity. The third cavity extends from the first end face to the second face and is substantially coaxial with the second cavity. A shackle is coupled to the first end face of the sleeve. A core member with a locking mechanism is disposed within the third cavity and coupled to the shackle. A driver member is located between the core member and the shackle and couples the core member to the shackle.

In another aspect, a hidden shackle style lock is disclosed. The lock has a substantially cylindrical housing with a top surface, a bottom surface, and a curved side surface. The lock also has a first cavity in the bottom surface extending part way along a thickness of the housing, and a second cavity in the side surface that intersects the first cavity. A sleeve is slidably attached within the second cavity, and a shackle assembly is fixedly attached to the sleeve. The shackle assembly includes a shackle member with locking features at one end and first mating features at an opposite end. The shackle assembly also includes a KiK lock cylinder with a key hole at one end and second mating features at an opposite end. A driver member, positioned between the shackle member and the KiK lock cylinder, interfaces with the first mating features and the second mating features.

In yet another aspect, the method of using a hidden shackle style lock having a KiK cylinder as a locking mechanism is disclosed. The method includes, slidably attaching a hollow sleeve within a first cavity of a housing of the lock, and coupling a shackle having a locking feature to the sleeve. The method also includes coupling a driver to the shackle, and coupling a first design feature of the KiK cylinder to a mating second design feature of the driver. The method further includes fixedly attaching the KiK cylinder to the sleeve, and inserting a hasp with a hole into a second cavity of the housing. The method further includes sliding the shackle through the hole in the hasp, and operating the locking mechanism to rotate the shackle and lockingly engage the locking feature to mating features in the housing.

DETAILED DESCRIPTION

Figure 1:
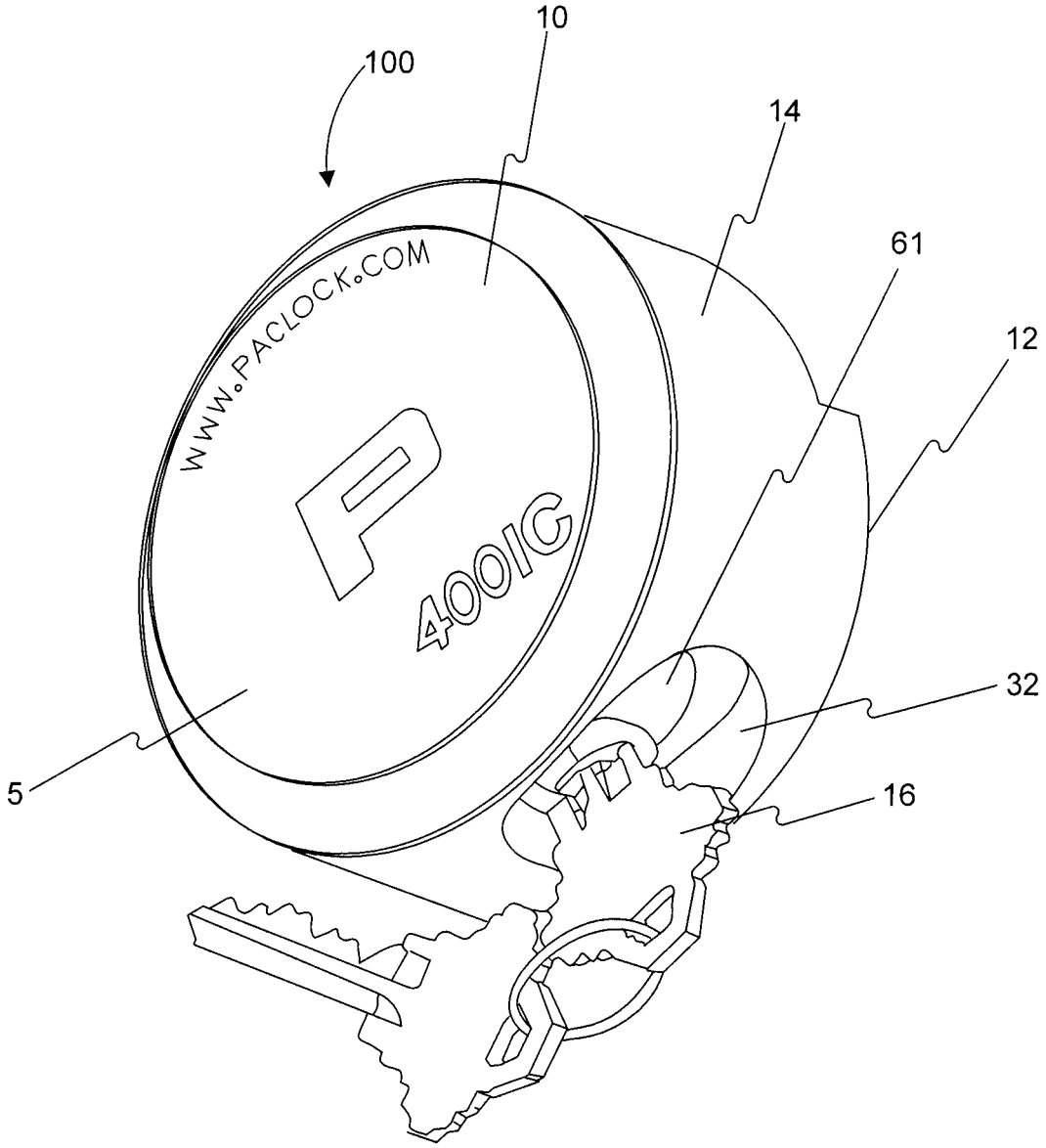
FIG. 1 is a diagrammatic illustration of an exemplary disclosed hockey puck lock.

FIG. 1 illustrates a hidden shackle style lock (locking device 100). The locking device 100 comprises a housing 5 having a generally circular cross-section with a generally circular front portion 10, a generally circular back portion 12, and a generally cylindrical side surface 14. It is also contemplated that the front portion 10, the back portion 12, and the side surface 14 may have other shapes. The front portion 10 and the back portion 12 may be planar or may be made up of multiple planar surfaces. The side surface 14 of the locking device 100 may include a side cavity 32 to insert the locking mechanism of the locking device 100. In some embodiments, the cross-section of the side cavity 32 (along a plane perpendicular to the front portion 10) has a rounded rectangular shape. However, the cross-section of the side cavity 32 may have other shapes, such as a square or an oval shape. One or more keys may also accompany the locking device 100. These keys may include an operator key 16. The operator key 16 may be used to lock and unlock the locking device 100.

Figure 2:
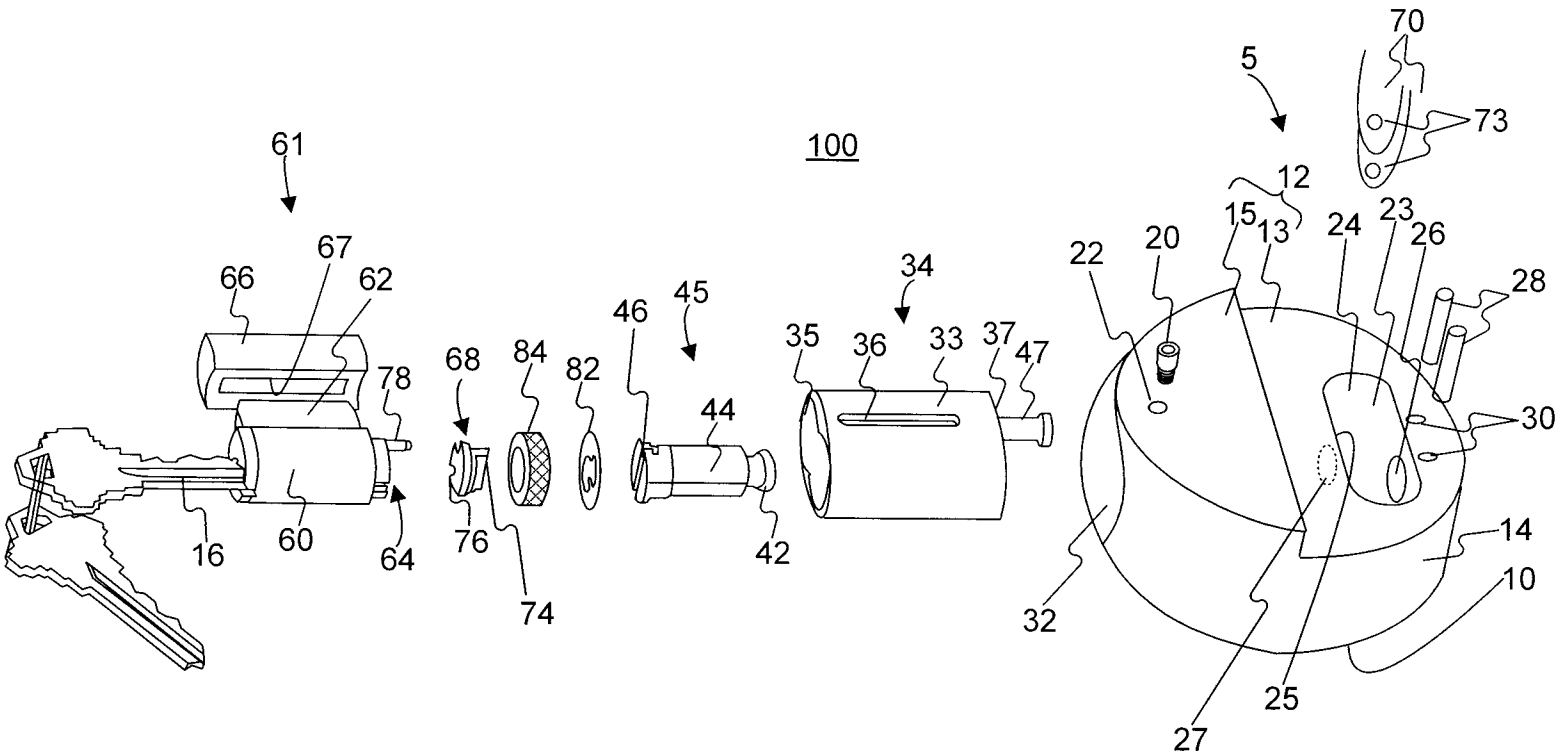
FIG. 2 illustrates an exploded view of the hockey puck lock of FIG. 1.

FIG. 2 illustrates the components that make up the locking system 100. The circular back portion 12 of the locking system 100 may be made of two planar surfaces—a first semi-circular portion 13 and a second semi-circular portion 15. In some embodiments, the first semi-circular portion 13 may be offset from the second semi-circular portion 15. It is contemplated that the back portion 12 may be made of one planar surface. It is also contemplated that the first semi-circular portion 13 and a second semi-circular portion 15 may have other shapes. The first semi-circular portion 13 may include a blind cavity 24. The blind cavity 24 may extend for a significant thickness of the locking device 100, but may not extend all the way to the front portion 10. The cross-section (along a plane parallel to the front portion 10) of the blind cavity 24 may be of a generally rectangular shape with rounded sides and edges. In some embodiments, the blind cavity 24 may be of another shape, such as a square, an oval, an elongated oval, or any other shape. The blind cavity 24 may have a first internal side wall 23 and a second internal side wall 25 which is opposite to the first internal side wall 23. The first internal side wall 23 may include a first cavity 26, and the second internal side wall 25 may include a second cavity 27. In one embodiment, the first cavity 26 may not protrude through the side surface 14 of the locking device 100. The first cavity 26 may have a generally cylindrical shape (other shapes are also possible). The second cavity 27 may join with the side cavity 32 extending from the side surface 14 of the housing 5. In some cases, the second cavity 27 may be the same as the side cavity 32. The first cavity 26 and the second cavity 27 may have their longitudinal axes parallel to each other. In some cases, the longitudinal axes of the first cavity 26 and the second cavity 27 may be collinear. The blind cavity 24 may receive and enclose the eyes 74 of a hasp and keeper 70 associated with a device to be locked by the locking device 100.

In this disclosure, the terms hasp and keeper 70 are used to designate two members used to lock doors and the like, which have forward projecting apertured eyes 73 adapted to be locked together, as by a padlock or a locking device 100. The hasp and keeper 70 may be fastened to the door structure by plates, pads, or any other fastening device. The hasp 70 may be mounted on the door (or the movable portion) while the keeper 70 may be mounted on a frame (or the fixed portion), but such plates may be reversed, or may be used with two movable doors (such as a double door), or any other kind of door. When the doors are closed, the eyes 73 of the hasp and keeper 70 may project from the face of the door structure in a face-to-face parallel relationship. To lock the closed door, the locking device 100 may be placed on the door such that the back portion 12 of the locking device 100 may be parallel to the face of the door and the forward projecting portions of the hasp and keeper 70 projects into the blind cavity 24 of the locking device 100. In this position, the eyes 73 of the hasp and keeper 70 may line up with both the first cavity 26 and the second cavity 27 in such a way that a straight shackle 44 inserted through the second cavity 27 may pass through the eyes 73, and into first cavity 26.

The back portion 12 of the locking device 100 may also have multiple pin slots 30 through which pins 28 may be inserted. A portion of the inserted pins 28 may pass through the first cavity 26 such that a cross-section of the first cavity 26 through the pins 28 reveal the circular cross-section of the first cavity 26 with the cross-section of each pin 28 occupying a segment of the circle on opposite sides. The portion of the pins 28 passing though the first cavity 26 may serve as locking flanges. As will be described in more detail below, the locking flanges formed by pins 28 in the first cavity 26 receive mating flanges of the shackle assembly 45 to lock the locking device 100.

The back portion 12 may also include a retaining hole 22 through which a retaining screw 20 passes. The retaining screw 20 may be threaded on its external surface. The internal surface of the retaining hole 22 may also be threaded to mate with threads on the retaining screw 20. The longitudinal axis of the retaining hole 22 may perpendicularly intersect the longitudinal axis of the side cavity 32 located on the side surface 14 of the housing 5. When the retaining screw 20 is screwed into the retaining hole 22, a portion of the retaining screw may protrude into the side cavity 32.

A sleeve 34 may be inserted into the side cavity 32 such that the longitudinal axis of the sleeve 34 is substantially collinear with the longitudinal axis of the side cavity 32. The sleeve 34 may have the shape of a hollow rectangular prism with rounded sides and parallel end surfaces—top surface 35 and bottom surface 37. The shape of the internal surface of the side cavity 32 may resemble the shape of the external surface of the sleeve 34, such that the external surface of the sleeve 34 and the internal surface of the side cavity 32 form curved mating surfaces. The term curved mating surfaces are used to refer to surfaces that, at any location, may be substantially parallel to each other. That is, the tangent at any point on one surface is substantially parallel to a tangent from the corresponding point of the other surface (for example, a hand and glove relation ship). A cross-section of the housing 5 along a plane perpendicular to the longitudinal axis of the side cavity 32 may reveal the sleeve 34 to have a rectangular cross-section with rounded sides circumscribed by the internal surface of the side cavity 32. The external dimensions of the sleeve 34 and the internal dimensions of the side cavity 32 may be such that the sleeve may be able to slide freely within the side cavity 32 without interference. It is also contemplated that portions of the external surface of the sleeve 34 may be in contact with the internal surface of the side cavity 32.

The sleeve 34 may also include an outer first surface 33 with a keyway 36. The keyway 36 may be a slot formed on the first surface 33 which extends part way through the thickness of the first surface 33. In some embodiments, the keyway 36 may extend through the entire thickness of the first surface 33. The keyway 36 may be formed on the center of the first surface 33 and may extend longitudinally over part of the length of the sleeve 34. The keyway 36 does not extend to the ends of the sleeve 34. When the sleeve 34 is inserted into the side cavity 32 of the housing 5 and the retaining screw 20 fastened to the retaining hole 22, the retaining screw 20 may extend into the keyway 36. The dimensions of the retaining screw 20 may be such that it permits the sleeve 34 to slide feely (travel) a certain distance within the side cavity 32 while preventing the sleeve 34 from being pulled out of the side cavity 32.

Figure 3:
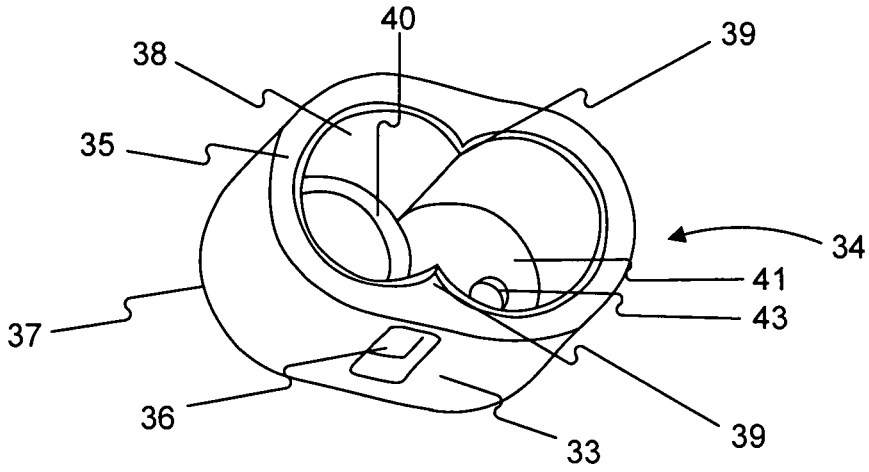
FIG. 3 illustrates an exemplary sleeve of the lock of FIG. 1.

FIG. 3 shows a view of the sleeve 34 with its internal surfaces visible. In the description of the sleeve 34 that follows, reference will be made to both FIGS. 2 and 3. The cross-section (along a plane parallel to the top surface 35) of the internal surface of the sleeve 34 may reveal intersecting circles resembling a figure "8". With such a shape, the internal surface of the sleeve 34 may have curved and projecting surfaces 39. The projecting surfaces 39 may be opposite to each other and may protrude into the hollow internal cavity 38 of the sleeve 34. When the sleeve 34 is inserted into the side cavity 32, the top surface 35 of the sleeve 34 may be exposed and visible from the side surface 14 of the locking device 100. The bottom surface 37 of the sleeve 34, opposite to the top surface 35, may have a closure plate 41 with a threaded hole 48 that covers one lobe of the intersecting circle while leaving open the other lobe. The open lobe may have a stepped recess 40 (visible in FIG. 5A) that acts as a seat for a shackle assembly 45.

Figure 4:
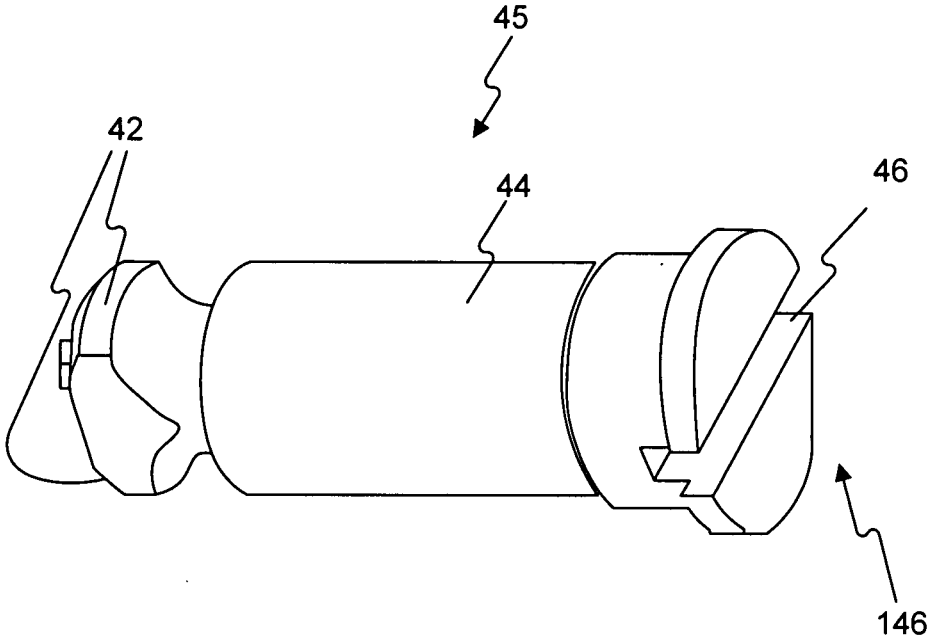
FIG. 4 illustrates an exemplary shackle assembly of the lock of FIG. 1.

FIG. 4 shows a shackle assembly 45 may include a shackle 44 having a substantially cylindrical shape. A rear end portion of the shackle 44 may include a pair of locking flanges 42. In some embodiments, the locking flanges 42 may be a machined feature on the shackle 44. It is also contemplated that the shackle 44 may be of another shape and the locking flanges 42 be formed by some other process, such as by fastening a separate locking flange section to the shackle 44. A forward end portion 146 of the shackle assembly 45 may include an elongated slot 46. The forward end portion 146 of the shackle assembly 45 may have larger diameter than the shackle 44. This larger diameter section may rest on the stepped recess 40 of the sleeve 34 when the shackle assembly is disposed within the hollow internal cavity 38. The elongated slot 46 may be machined on the shackle, or may be formed on a separate part which is then attached to the forward end portion 146 of shackle 44.

Figure 5A:
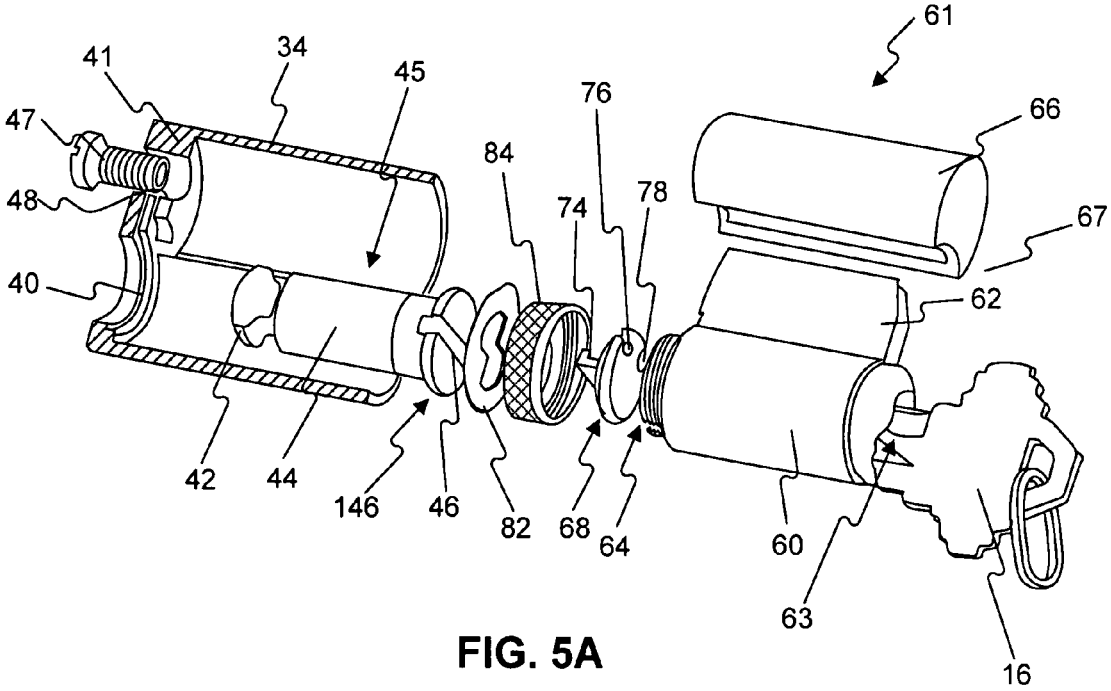
FIG. 5A illustrates an exploded view of an exemplary sleeve, shackle assembly, driver, and lock core of the lock of FIG. 1.
Figure 5B:
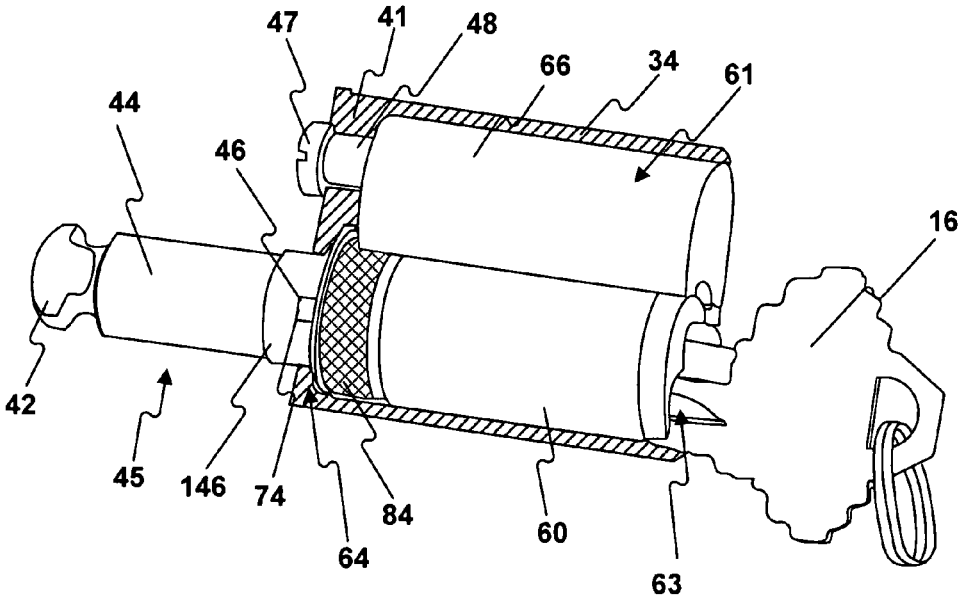
FIG. 5B illustrates the assembled configuration of the components of FIG. 5A.

FIG. 5A shows an exploded view of a lock core 61 that may be coupled to the forward end portion 146 of the shackle assembly 45. FIG. 5B shows the components of FIG. 5A assembled together. In the explanation that follows, reference will be made to both FIGS. 5A and 5B. The lock core 61 may include a KiK cylinder 60 and a cylinder retaining plug 66. The KiK cylinder 60 may have a generally cylindrical shape with two opposite parallel surfaces—a front surface 63, and a tail 64—as its end faces, and a curved surface between them. The curved surface of KiK cylinder 60 may include a bible 62 extending longitudinally along the KiK cylinder 60. The bible 62 may have a generally rectangular cross-sectional shape along a plane perpendicular to a longitudinal axis of the KiK cylinder 60. However, other cross-sectional shapes of the bible 62 are also contemplated. The cylinder retaining plug 66 may have a cylindrical shape and, in general, may have a size comparable to that of the KiK cylinder 60. The cylinder retaining plug 66 may include a cavity 67 extending longitudinally along a curved external surface. The cross-sectional shape of the cavity 67 may match that of the bible 62. The bible 62 may be inserted into the cavity 67 of the cylinder retaining plug 66 to couple the two parts together and form a lock core 61. In the coupled configuration, the cross-sectional shape of the lock core 61 along a direction perpendicular to its longitudinal axis may resemble a figure "8." The cross-sectional shape of the lock core along a plane perpendicular to the longitudinal axis of the KiK cylinder 60, may be substantially similar to the cross-sectional shape of the hollow internal cavity 38 of the sleeve 34.

The front surface 63 of lock core 61 may include a key hole that accepts an operator key 16. The tail 64 may have features configured to couple with the shackle assembly 45. The features on tail 64 may different configurations depending upon the manufacturer of the KiK cylinder 60. FIG. 5A depicts a KiK cylinder 60 manufactured by Schlage®. The tail 64 of the Schlage® KiK cylinder 60 may include pins 78 protruding from the tail 64. Tail 64 of KiK cylinders manufactured by other manufacturers may include other features. For example, cavities or protrusions in a specific pattern. In general, the tail 64 may have one of three standard configurations (as found in KiK cylinders manufactured by Schlage®, Medeco®, and Lori companies). KiK cylinders from Medeco® and Lori companies may have cavities along a diagonal of the tail 64.

Figure 6A:
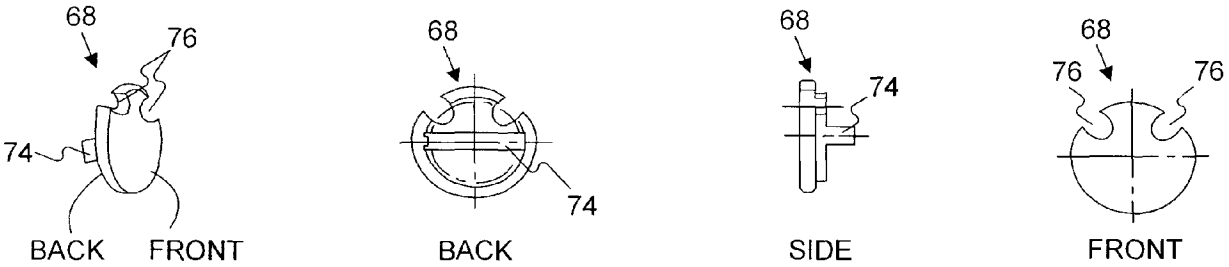
FIG. 6A-C illustrates three exemplary drivers for use with the lock of FIG. 1.
Figure 6B:
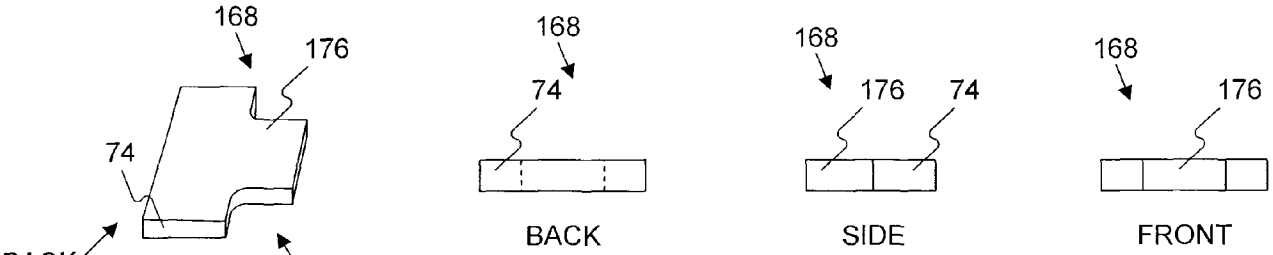
Figure 6C:
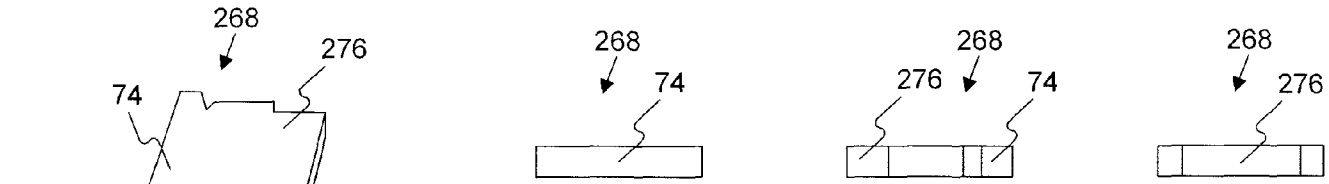

A first driver 68 may couple the tail 64 end of the lock core 61 to the forward end portion 146 of the shackle assembly 45. FIG. 6A shows multiple views of the driver 68. The first driver 68 may include a rectangular protrusion 74 at one end to mate with the elongated slot 46 on the forward end portion 146 of the shackle assembly 45. The opposite end of the first driver 68 may include one or more curved recess 76 configured to mate with the one or more pins 78 extending from the tail 64 of KiK cylinder 60. FIGS. 6B and 6C show multiple views of a second driver 168 and a third driver 268, respectively. The second and third drivers 168 and 268, may also include the rectangular protrusion 74 to mate with the elongated slot 46 of the shackle assembly 45. The opposite end of the second and third drivers 168 and 268, may have different features to mate with tail features of KiK cylinders from different manufacturers. For instance, second driver 168 may have a rectangular protrusion 176 sized to mate with a rectangular cavity on the tail 64 of a KiK cylinder manufactured by Medeco® company. Likewise, third driver 268 may have a rectangular protrusion 276 sized to mate with a rectangular cavity on the tail 64 of a KiK cylinder manufactured by Lori company.

As best seen in FIG. 5A, a retaining ring 84 may couple the first driver 68 to the lock core 61. The retaining ring 84 may have internal threads that mate with external threads on the external cylindrical surface of the KiK cylinder 60. To couple the first driver 68 to the lock core 61, the curved recesses 76 of the first driver may be mated with the pins 78 on the tail 64 of KiK cylinder 60. The retaining ring 84 may now be slipped over the first driver 68 and the internal threads of the retaining ring 84 screwed on the external threads of the KiK cylinder 60. The first driver 68 may now be snugly coupled with the lock core 61. The second and the third driver 168 and 268, may also be similarly coupled with appropriate KiK cylinders. In the coupled configuration, the rectangular protrusion 74 may protrude from one end of the lock core 61. The rectangular protrusion 74 may mate with the elongated slot 46 of the shackle assembly 45. A stopper 82 may be sandwiched between the lock core 61 and the shackle assembly 45. The stopper 82 may restrict the rotation of the first driver 68 to only the clockwise direction.

To couple the lock core 61 to the shackle assembly 45 and the sleeve 34, as seen in FIG. 5B, the KiK cylinder 60 is first coupled with the retaining plug 66 to form the lock core 61. The first driver 68 may then be coupled to the tail 64 of the KiK cylinder 60 using the retaining ring 84. The shackle assembly 45 may then be inserted into the hollow internal cavity 38 of the sleeve 34, such that the shackle 44 protrudes through the exposed lobe on the bottom surface 37 of the sleeve 34. In this inserted configuration, the forward end portion 146 of the shackle assembly 45 may rest on the stepped recess 40 of sleeve 34, with the elongated slot 46 visible through the hollow internal cavity 38. The coupled lock core 61 with the stopper 82 may be inserted into the hollow internal cavity 38 to mate the rectangular protrusion 74 of the first driver 68 with the elongated slot 46 of the shackle assembly 45. A threaded screw 47 may then be screwed into a threaded cavity of the retaining plug 61 through the threaded hole 48 on the closure plate 41 to secure the lock core 61 to the sleeve 34.

With the shackle assembly 45 and the lock core 61 attached to the sleeve 34, the sleeve 34 may be inserted into the side cavity 32 of housing 5. The sleeve 34 may be secured to the housing 5 using the retaining screw 20 (see FIG. 2). The retaining screw 20 protrudes into the keyway 36 of the sleeve 34 allowing the sleeve 34 (along with attached shackle assembly 45 and lock core 61) to slide in the housing 5, while preventing them from being detached from the housing 5. The distance of allowable sliding may depend on the length of the keyway 36. The lengths of the keyway 36 may be such that the locking flanges 42 on the rear end portion of the shackle 44 may travel the entire thickness of the blind cavity 24 and the depth of the first cavity 26 to lockingly engage with locking features therein.

INDUSTRIAL APPLICABILITY

Hidden shackle style locks are widely used as high security locking devices since their shackles are inaccessible to an unauthorized person, and therefore difficult to cut. KiK cylinders are the mainstay of most residential and commercial locking devices. The disclosed locking device 100 retains the advantages of conventional hidden shackle style locks while incorporating the convenience of using a commonly available KiK cylinder as the locking mechanism. A conventional hockey puck lock is modified to include a hollow sleeve 34 to interface with the KiK cylinder 60 and the housing 5 of the locking device 100. A shackle assembly 45 with a shackle 44 is also rigidly attached to the KiK cylinder 60 with their longitudinal axes parallel to each other. The sleeve 34 is slidably disposed on the housing 5 of the locking device 100, and is secured to the housing 5 using a retaining screw 20. The retaining screw 20 permits the sleeve 34 and the shackle 44 to slide along their longitudinal axis, while preventing them from being detached from the housing 5.

A commonly available KiK cylinder 60 is coupled to a cylindrical retaining plug 66 and disposed within the internal cavity 38 of the sleeve 34. When the KiK cylinder 60 is thus disposed, features at the tail end of the KiK cylinder 60 mates with corresponding features on a top surface of the shackle assembly 45. In this configuration, operating the locking mechanism of the KiK cylinder 60, allows the shackle 44 to rotate and engage with locking features of the lock housing 5. To accommodate KiK cylinders from different manufactures which may have different features at the tail end 64, a driver is coupled to the tail end of KiK cylinder to act as an intermediary between the mating features of the KiK cylinder and the corresponding features of the Shackle assembly. Three different drivers, each having design features to accommodate a different tail end mating feature, are provided to permit the use of most commonly available KiK cylinders with the locking device 100.

The operation of the locking device 100 will now be briefly described. The doors to be locked using the locking device 100 is closed such that the hasp 70 mounted on the door and the keeper 70 mounted on a frame beside the door project outwards from the face of the door structure in a face-to-face parallel relationship. In this orientation, the eyes 74 of the hasp and keeper 70 may be in line with each other. That is, the longitudinal axis of the eyes 74 may be substantially collinear.

The locking device 100 may be placed on the door such that the back portion 12 of the locking device 100 may be flush with the face of the door, with the forward projecting portions of the hasp and keeper 70 projecting into the blind cavity 24 of the locking device 100. In this position, the eyes 74 of the hasp and keeper 70 may line up with the first cavity 26 and second cavity 27 of the locking device 100. The sleeve 34 (along with the attached shackle assembly 45 and the lock core 61) may be pushed into the side cavity 32 such that the top surface 35 of the sleeve is closest to the side surface 14 of the housing 5. In this position, the shackle 44 passes through the eyes 74 of the hasp and keeper 70, and into the first cavity 26. The operator key 16 may then be inserted into the key hole on the front surface 63 of the KiK cylinder 60 and turned. If the correct key is used, the locking mechanism of the KiK cylinder 60 operates, rotating the shackle 44. When the shackle 44 rotates, the locking flanges 42 at the end of the shackle 44 engages with the pins 28 (locking features) within the first cavity 26. When the locking feature 42 engages with the pins 28, the shackle 44 is prevented from being pulled out of the first cavity 26, thereby locking the hasp and keeper 70 together.

It will be apparent to those skilled in the art that various modifications and variations can be made to the disclosed hidden shackle style lock. Other embodiments will be apparent to those skilled in the art from consideration of the specification and practice of the hidden shackle style lock disclosed herein. It is intended that the specification and examples be considered as exemplary only, with a true scope being indicated by the following claims and their equivalents.

What is claimed is:

1. A hidden shackle style lock comprising;

a substantially cylindrical housing having a top surface, a bottom surface, and a curved side surface;

a first cavity on the bottom surface of the housing extending part way along a thickness of the housing;

a second cavity on the side surface intersecting with the first cavity;

a hollow sleeve slidably attached within the second cavity, the sleeve including a first end face, a second end face, and a third cavity, the third cavity extending from the first end face to the second face and being substantially coaxial with the second cavity;

a shackle coupled to the first end face of the sleeve;

a core member having a locking mechanism disposed within the third cavity and coupled to the shackle; and a driver member axially positioned between the core member and the shackle and coupling the core member to the shackle, the driver member including a first design feature on a first side and a separate second design feature on a second side that is opposite the first side, wherein the first design feature is adapted to couple to the core member and the second design feature is adapted to couple to the shackle.

2. The hidden shackle style lock of claim 1, wherein the driver member resembles a substantially flat disk with the first side and the second side being opposite surfaces, and wherein the second design feature includes a protrusion and the first design feature includes one or more third design features, the protrusion being configured to mate with a cavity on a mating surface of the shackle, and the one or more third design features being configured to mate with corresponding features on a mating surface of the core member.

3. The hidden shackle style lock of claim 2, wherein the one or more third design features includes one or more recesses and the corresponding features includes one or more pins configured to mate with the one or more recesses.

4. The hidden shackle style lock of claim 2, wherein the one or more third design features includes a second protrusion and the corresponding features includes a fourth cavity configured to mate with the second protrusion.

5. The hidden shackle style lock of claim 1, wherein the core member includes a key-in-knob cylinder.

6. The hidden shackle style lock of claim 1, wherein the core member includes a key-in-knob cylinder coupled with a cylindrical plug and a cross-sectional shape of the core member along a plane perpendicular to a longitudinal axis of the core member substantially resembles a figure "8".

7. The hidden shackle style lock of claim 1, wherein the core member is fastened within the third cavity using a threaded fastener attached to the first end face of the sleeve.

8. The hidden shackle style lock of claim 1, wherein the sleeve is configured to slide within the second cavity from a first position to a second position, the first position being a position where the first end face is proximate to the curved side surface, and the second position being a position where the second end face is proximate to the curved side surface.

9. The hidden shackle style lock of claim 1, wherein the core member includes a front end and a back end, the front end including a key hole to operate the locking mechanism and the back end including features configured to mate with the driver member, the core member being disposed within the third cavity such that the front end is proximate the second end of the sleeve.

10. The hidden shackle style lock of claim 9, wherein operation of the locking mechanism rotates the driver member and the shackle.

11. The hidden shackle style lock of claim 1 further including:

a fifth cavity on a side wall of the first cavity, the fifth cavity being substantially coaxial with the second cavity, and one or more first locking features within the fifth cavity.

12. The hidden shackle style lock of claim 11, wherein the shackle has a substantially cylindrical shape with opposing first end and a second end, the first end being coupled to the driver and the second end including locking flanges.

13. The hidden shackle style lock of claim 12, wherein operation of the locking mechanism engages the locking flanges with the locking features.

14. A hidden shackle style lock comprising;

a substantially cylindrical housing with a top surface, a bottom surface, and a curved side surface;

a first cavity in the bottom surface extending part way along a thickness of the housing;

a second cavity in the side surface intersecting with the first cavity;

a sleeve slidably attached within the second cavity; and a shackle assembly fixedly attached to the sleeve; the shackle assembly including, a shackle member with locking features at one end and first mating features at an opposite end, a key-in-knob lock cylinder with a key hole at one end and second mating features at an opposite end, and a driver member axially positioned between an end face of the shackle member and an end face of the key-in-knob lock cylinder, the driver member including a first design feature on a first side and a separate second design feature on a second side that is opposite the first side, wherein the first design feature interfaces with the second mating features of the key-in-knob lock cylinder and the second design feature interfaces with the first mating features of the shackle.

15. The hidden shackle style lock of claim 14, wherein the second design feature of the driver member is a rectangular protrusion.

16. The hidden shackle style lock of claim 15, wherein the first design feature of the driver member includes one or more recesses and the second mating features of the key-in-knob lock cylinder include one or more pins.

17. The hidden shackle style lock of claim 16, wherein the first design feature of the driver member includes a projection and the second mating features of the key-in-knob lock cylinder include a cavity.

18. The method of using a hidden shackle style lock having a key-in-knob cylinder as a locking mechanism comprising;

slidably attaching a hollow sleeve within a first cavity of a housing of the lock;

coupling a shackle having a locking feature to the sleeve;

coupling a driver to the shackle, the driver including a first design feature on a first side and a separate second design feature on a second side that is opposite the first side, wherein the the second design feature is adapted to couple to the shackle;

coupling a mating third design feature of the key-in-knob cylinder to the first design feature of the driver;

fixedly attaching the key-in-knob cylinder to the sleeve;

inserting a hasp with a hole into a second cavity of the housing;

sliding the shackle through the hole in the hasp; and operating the locking mechanism to rotate the shackle and lockingly engage the locking feature to mating features in the housing.

19. The method of claim 18, further including, replacing the key-in-knob cylinder with a second key-in-knob cylinder having a different third design feature;

replacing the driver with a second driver having a different first design feature.

20. The method of claim 18, wherein operating the locking mechanism rotates the driver about an axis parallel to a longitudinal axis of the key-in-knob cylinder.

* * * * *